United States Patent [19]

Berfield

[11] Patent Number: 4,547,927

[45] Date of Patent: Oct. 22, 1985

[54] COMPACT VACUUM CLEANER

[75] Inventor: Robert C. Berfield, Jersey Shore, Pa.

[73] Assignee: Shop-Vac Corporation, Williamsport, Pa.

[21] Appl. No.: 559,335

[22] Filed: Dec. 8, 1983

[51] Int. Cl.[4] ..... A47L 9/22

[52] U.S. Cl. ..... 15/327 F; 15/412

[58] Field of Search ..... 15/327 F, 327 E, 412, 15/350

[56] References Cited

U.S. PATENT DOCUMENTS

| | | | |
|---|---|---|---|
| 2,037,557 | 4/1936 | Ahnstrom | 15/327 E X |
| 2,044,830 | 6/1936 | Carlstedt | 15/327 E X |
| 2,183,737 | 12/1939 | Bilde | 15/327 E X |
| 2,245,760 | 6/1941 | Clements | 15/327 E X |
| 2,349,215 | 5/1944 | Wahlborg | 15/327 E X |
| 3,142,857 | 8/1964 | Fresard et al. | 15/327 E |
| 3,667,084 | 6/1972 | Valbona et al. | 15/350 X |

*Primary Examiner*—Chris K. Moore

*Attorney, Agent, or Firm*—Ostrolenk, Faber, Gerb & Soffen

[57] ABSTRACT

A vacuum cleaner is constructed of relatively rigid, molded plastic main structural elements including a dirt collecting tank and a motor housing releaseably secured to each other by a buckle. The main structural plastic elements also include a fan housing wherein a centrifugal fan rotates, a mounting plate to which the motor is secured; and a baffle member having a cup formation which receives the rear of the motor. A common fastening means mechanically secures the fan housing, the plate, and the baffle member to the motor housing. A releaseable latch is at one end of the buckle and a hook at the other end thereof. The latch holds the tank and motor housing together, and the hook is for engaging a wall bracket to mount the cleaner in a vertical position. The buckle also includes a skid portion, located between the latch and hook, to facilitate movement of the cleaner along a horizontal supporting surface. Hundreds of relatively small apertures in the mounting plate are arranged in a narrow band adjacent the periphery of the fan so as to provide for the passage of air through the motor mounting plate without creating excessive back pressure while maintaining quiet conditions in spite of high speed air flow.

14 Claims, 13 Drawing Figures

COMPACT VACUUM CLEANER

BACKGROUND OF THE INVENTION

This invention relates to vacuum cleaners in general and more particularly relates to cannister type vacuum cleaners that may be wheeled about and may also be conveniently hand carried while in use.

Cannister type vacuum cleaners are often provided with wheels and/or skids to facilitate moving of the vacuum cleaner during use thereof. Sometimes it is desirable to utilize this type of vacuum cleaner for cleaning stairs and elevated locations that do not have any surfaces in the vicinity to support the vacuum cleaner while it is in operation. Prior art vacuum cleaners of this type are, for the most part, either too bulky or heavy to be carried conveniently over an extended period of time, especially when they must be carried in only one hand while the other hand is being used to maneuver a cleaning tool.

One prior art attempt to solve this problem is set forth in U.S. Pat. No. 3,599,273 which issued Aug. 17, 1971 to K. Shirayangi et al. for a Vacuum Cleaner. In the aforesaid U.S. Pat. No. 3,599,273 when the cannister vacuum is to be held by the user, the vacuum must be split into two sections, one of which is handheld and the other of which may be shoulder carried. This appears to be an extremely awkward arrangement and it would appear that an inordinate amount of time is required for separating and reassembling the secitons of the vacuum cleaner.

SUMMARY OF THE INVENTION

As will hereinafter be seen, the instant invention provides a vacuum cleaner of compact relatively light weight construction that may be moved along the floor on wheels and may also be conveniently handheld during operation thereof. Except for the electric motor, all of the major compenents are molded plastic elements that are readily assembled to form a unitary structure.

Accordingly, a primary object of the instant invention is to provide a novel construction for a cannister type vacuum cleaner that is convenient to carry and is also convenient to move along a supporting surface.

Another object is to provide a vacuum cleaner of this type that is relatively inexpensive and is reliable.

Still another object is to provide a vacuum cleaner of this type that does not require gaskets between separable casing elements.

Yet another object is to provide a common fastening means for mechanically securing most of the major elements together in cooperating relationship.

A further object is to provide a vacuum cleaner of this type that includes a one-piece molded buckle having a portion for latching casing sections together in operative relationship, a glide or skid section to support the cleaner as it is being moved along the floor and a hook section for hanging the cleaner on a wall mounted hook.

A still further object is to provide a vacuum cleaner of this type in which the outlet for air from the chamber for the fan blade consists of hundreds of relatively small apertures arranged in a narrow annular array so as to reduce noise without creating excessive pressure.

These objects, as well as other objects of this invention, shall become apparent after reading the following description of the accompanying drawings, in which:

DESCRIPTION OF A PREFERRED EMBODIMENT

Figure 1:
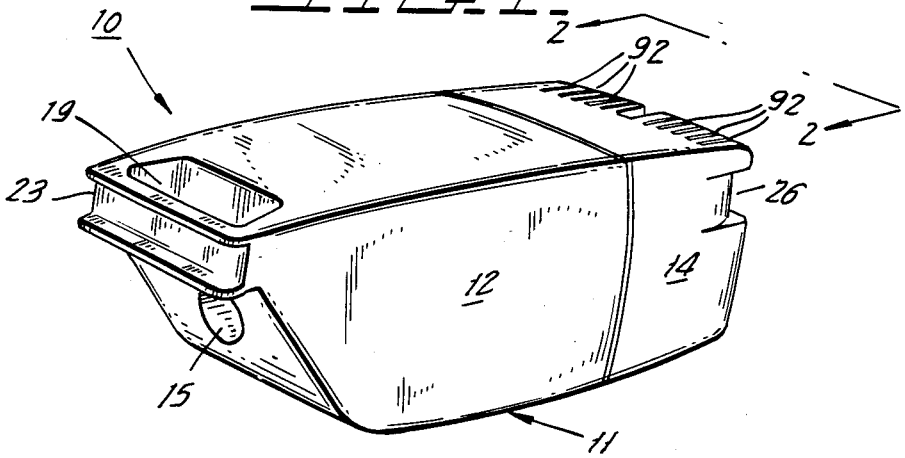
FIG. 1, is a perspective, looking generally at the intake or front end of a vacuum cleaner constructed in accordance with teachings of the instant invention.
Figure 2:
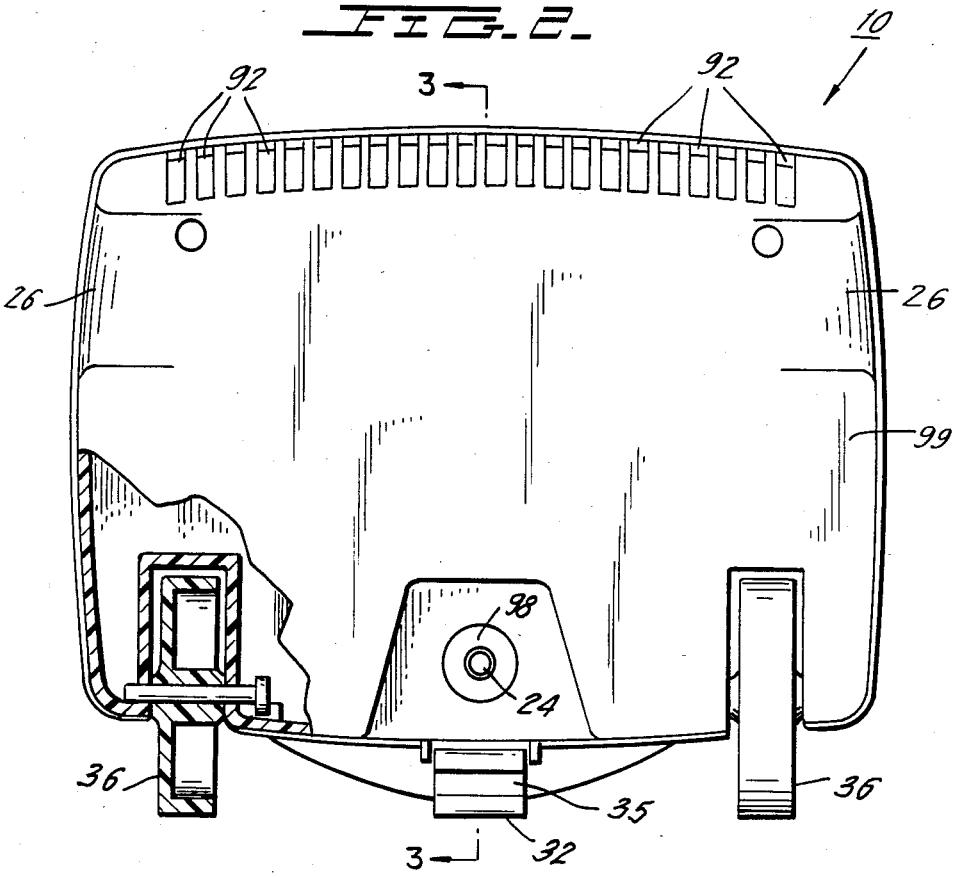
FIG. 2 is a rear elevation of the vacuum cleaner of FIG. 1, looking in the direction of arrows 2—2 of FIG. 1.
Figure 3:
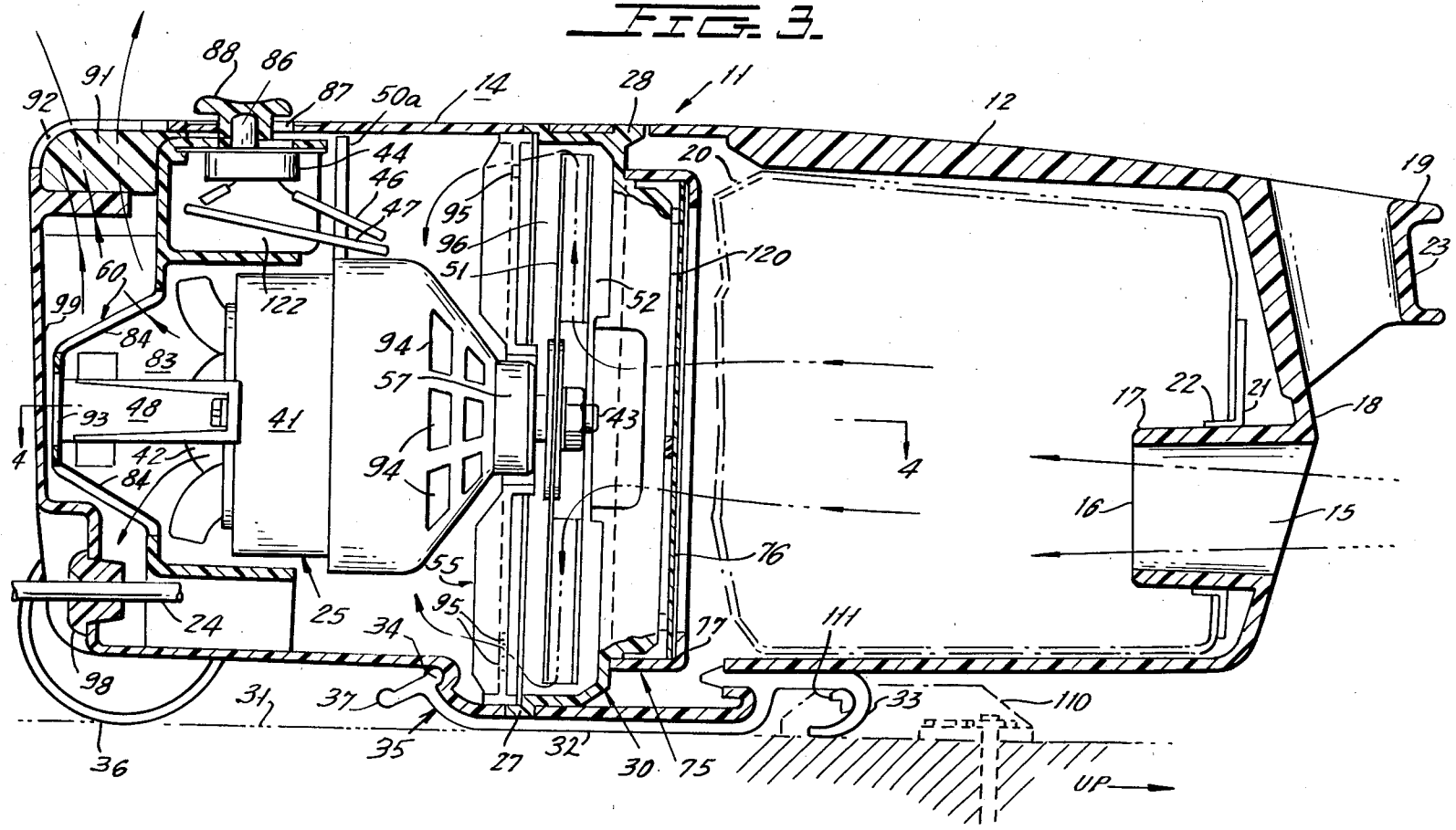
FIG. 3 is a cross-section taken through line 3—3 of FIG. 2, looking in the direction of arrows 3—3.
Figure 4:
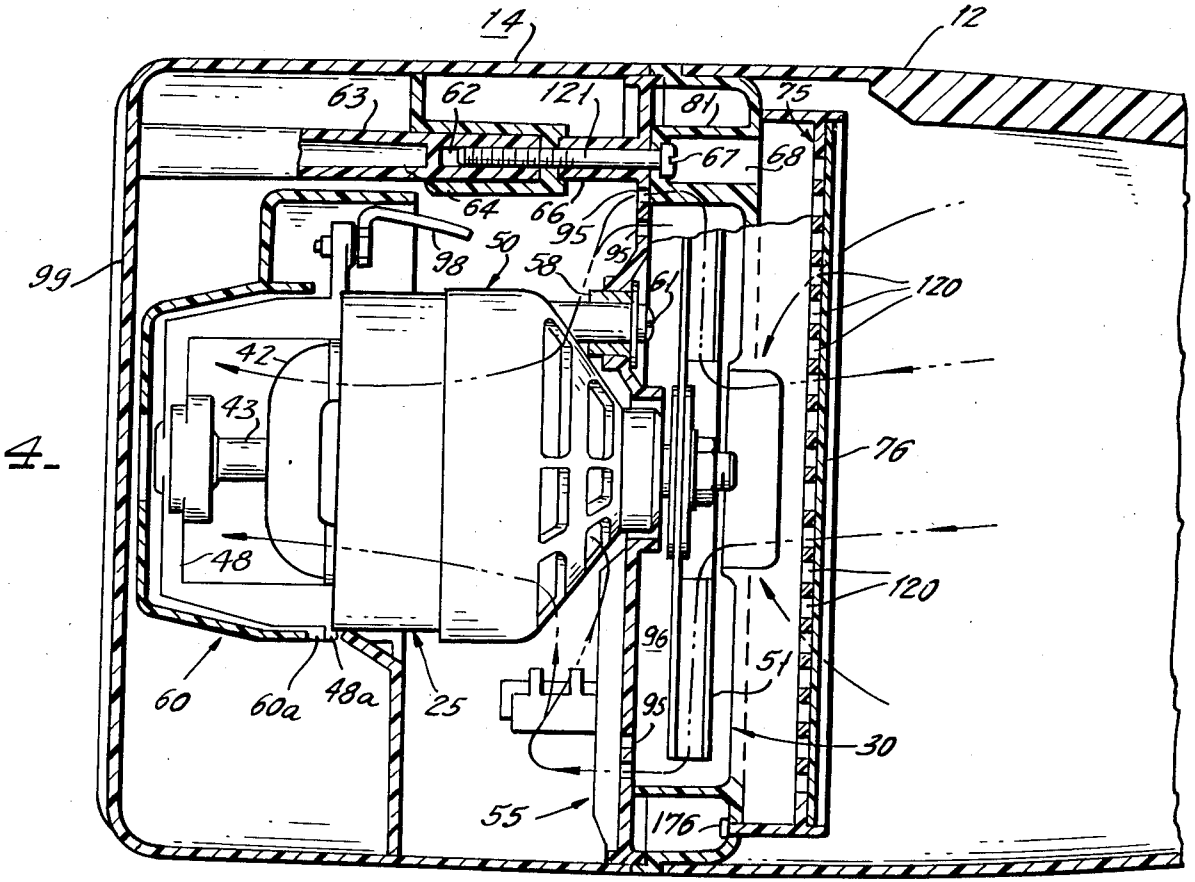
FIG. 4 is an enlarged fragmentary cross-section through line 4—4 of FIG. 3, looking in the direction of arrows 4—4.

Now referring to the Figures, cannister type vacuum cleaner 10, constructed in accordance with teachings of the instant invention, includes casing 11, have a tank section 12 at the front and motor housing 14 at the rear. As seen in FIGS. 3 and 4, disposed within casing 11 are motor 25 and main molded plastic elements 75 (secondary filter support), 30 (fan housing), 55 (motor mounting plate) and 60 (baffle).

Inlet 15 to tank 12 is through passage 16 defined by cylindrical neck 17 that extends rearward from front surface 18 of tank 12. Handle 19 molded integrally with tank 12 is disposed at the front thereof in a position that permits one end of a tool hose (not shown) to be removably connected to tank 12 over its inlet 15. Dirt drawn into tank 12 through inlet 15 is trapped within porous paper bag 20 that acts as a primary filter in protecting air-cooled motor 25 against dust and dirt. Stiffener 21 at the open end of bag 20 is provided with annular collar 22 that surrounds neck 17 and is wedged thereagainst two removably secure bag 20 to neck 17.

Depression 23 in the front surface of handle 19 defines a space for the storage of line cord 24 as it is wound around casing 11. Other storge spaces for line cord 24 are provided by depressions 26, 26 along opposite edges of motor housing 14 at the rear thereof. Tank 12 and housing 14 abut the front and rear surfaces respectively of narrow, generally rectangular band formation 27 formed integrally with fan housing 30 at the rear thereof. As seen in FIG. 3 fan housing 30 is also provided with shallow upward projection 28 positioned forward of band formation 27. Projection 28 is received by a complementary depression in the internal surface of tank 12 in the vicinity of the rear end thereof so that the top of the tank is held in position by projection 28.

The bottom of tank 12 at the transverse center thereof mounts buckle 35 that is a one piece molded plastic member, preferably constructed of nylon or acetel and including latch formation 34 at one end thereof, hook formation 33 at the other end thereof and skid 32 at the mid-region thereof. When the supporting surface 31 (FIG. 3-4) for vacuum 10 is horizontal, skid 32 engages surface 31 as do wheels 36, 36 that are rotatably mounted to motor housing 14 at the rear thereof.

Latch 34 is received by a cooperating depression in motor housing 14 to firmly secure the lower portions of tank 12 and motor housing 14 together. This connection is releasable in that latch 34 may be removed from its cooperating depression in motor housing 14 by applying force at finger-engagable extension 37, formed integrally with buckle 35, at the rear thereof to bend buckle 35 as required to release latch 34.

Motor 25 is disposed within housing 14 and includes stator 41 and rotor 42 having shaft 43 extending therethrough. The windings of rotor 42 are electrically connected to line cord 24 in a conventional manner including switch 44 and leads 46, 47, 98. Grommet 98 (FIG. 3) surrounds line cord 24 where it enters housing 14 through rear wall 99 thereof. Shaft 43 is rotatably supported by bearings (not shown) disposed at opposite ends thereof, with one of these bearings being mounted to U-shaped bracket 48 and the other being mounted to molded plastic end bell 50.

Figure 6:
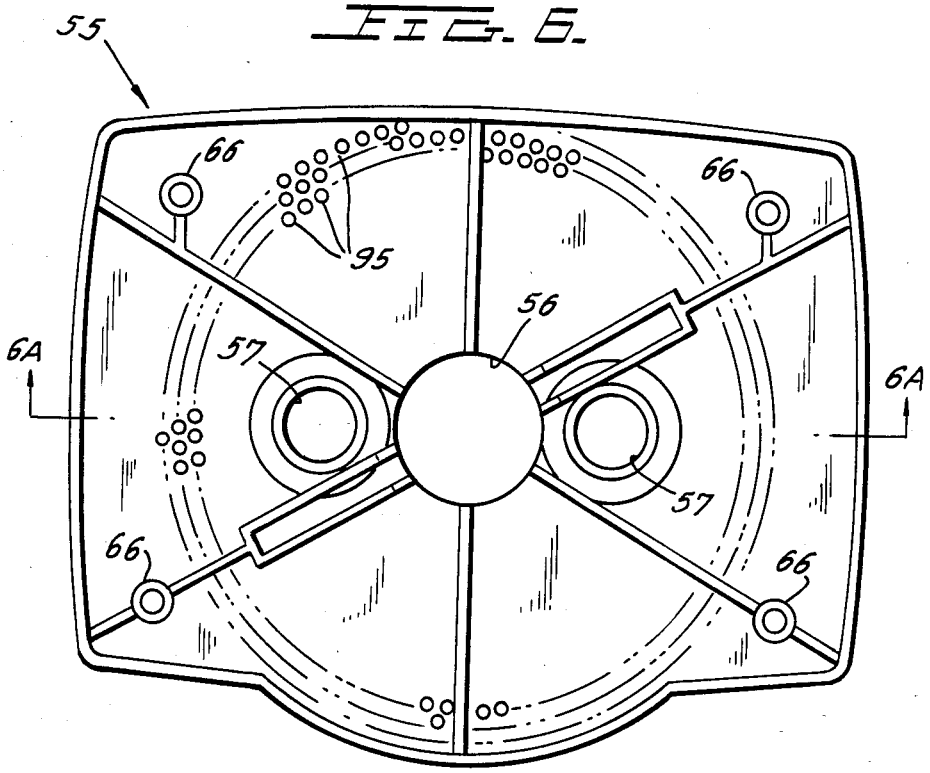
FIG. 6 is an elevation looking at the rear facing surface of the motor mounting plate.
Figure 6A:
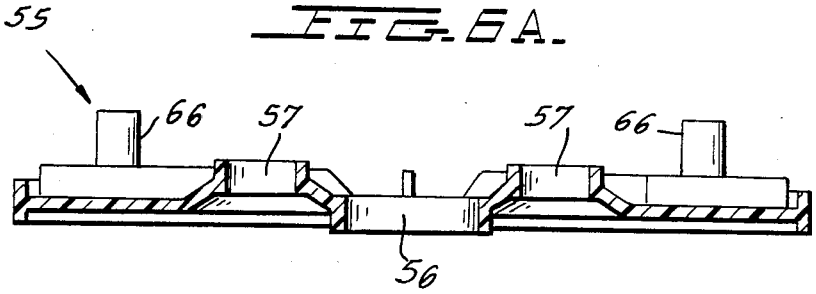
FIG. 6A is a cross-section taken through line 6A—6A of FIG. 6, looking in the direction of arrows 6A—6A.

Pancake type centrifugal fan impeller 51 is secured to the rear end of motor shaft 43 so as to be rotable therewith. Impeller 51 is disposed within shallow chamber 52 that is defined by fan housing 30 and is substantially closed at the rear thereof by motor mounting plate 55 (FIG. 6). The latter includes circular aperture 56 at the center thereof to received annular extension 57 at the front of end bell 50. Mounting plate 55 also extended apertures 57, 57 disposed on opposite sides of central aperture 56. Each aperture 57 receives a bushing 58 that surrounds a stud 59 formed integrally with end bell 50. Mechanical securement of motor 25 to its mounting plate 55 is completed by screws 61, 61 that are threadably received in longitudinal passages (not shown) that extend to the fronts of studs 59, 59.

Figure 7A:
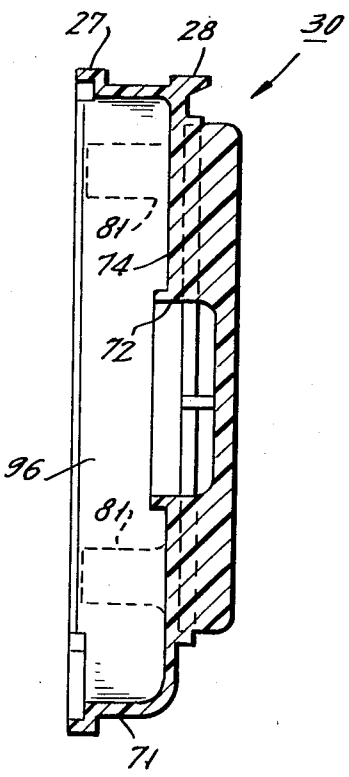
FIG. 7A is a cross-section taken through line 7A—7A of FIG. 7, looking in the direction of arrows 7A—7A.
Figure 7:
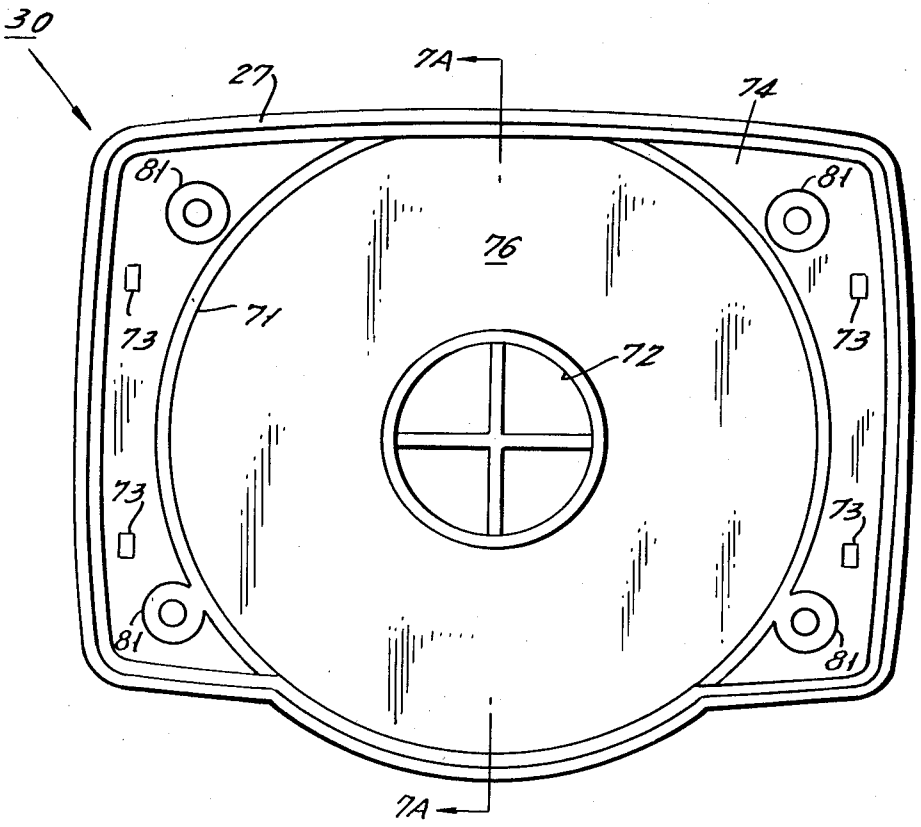
FIG. 7 is an elevation looking at the rear facing surface of the fan housing.

Fan housing 30 (FIG. 7), motor mounting plate 55 and baffle 60 at the rear of motor 25 are mechanically secured within motor housing 14 by a common fastening means provided by four screws 121 each of which is threadably received in an individual passage 62 that extends to the forward end of one of four posts 63 that are disposed within motor housing 14 and extend forward from rear wall 99 thereof, being molded integrally therewith. Each post 63 extends into one of four hollow studs 64 through the open rear end thereof. Stud 64 includes a shallow depression at its front end which receives the rear end of a post 66 that extends rearward from motor mounting plate 55. Post 66 and stud 64 are provided with clearance apertures through which screw 121 extends. Head 67 of screw 121 bears against the forward facing surface of fan housing 30 that is at the rear of longitudinal depression 68 and stud 81.

Figure 8:
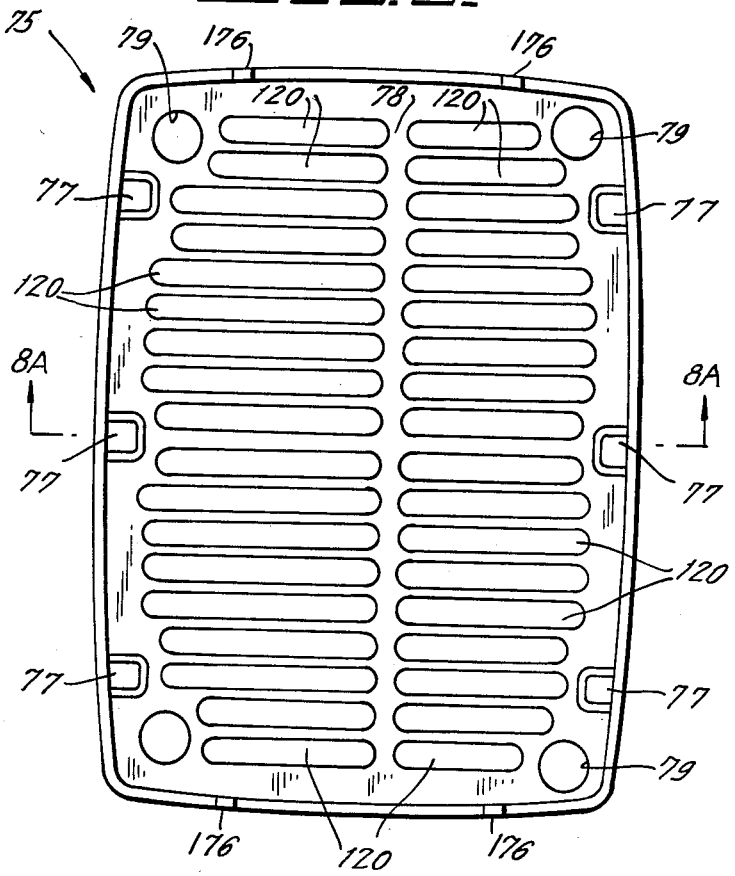
FIG. 8 is an elevation looking at the rear facing surface of the support for the secondary filter.
Figure 8A:
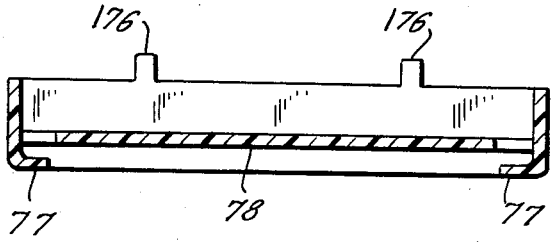
FIG. 8A is a cross-section taken through line 8A—8A of FIG. 8, looking in the direction of arrows 8A—8A.

Fan housing 30 also includes annular wall 71 that is concentric with the outer edge of impeller 51 and in close proximity thereto. Central aperture 72 in transverse wall 74 of housing 30 is concentric with wall 71 and provides the inlet through which air reaches impeller 51. Disposed outboard of wall 71 are four apertures 73 that extend through the fan housing wall 74. Each aperture 73 receives one of four rearwardly projecting ears 176 of support 75 (FIG. 8) for secondary filter 76, the latter being a sheet of filter material that is removably held by six inwardly projecting tabs 77 of support 75. The rear ends of tabs 74 are upset, as by applying heat thereto, thereby mechanically securing support 75 to the front of fan housing 30. Main plate-like section 78 of support 75 is provided with an array of slots 120 to minimize interference with airflow to impeller 51 and to utilize a maximum amount of filter area. Apertures 79 at the corners of main section 78 are aligned with depressions 68 to permit access to heads 67 of screws 121 when filter 76 is removed. Screw heads 67 are not visible to the user when filter 76 is in operative position during normal use.

Figure 5A:
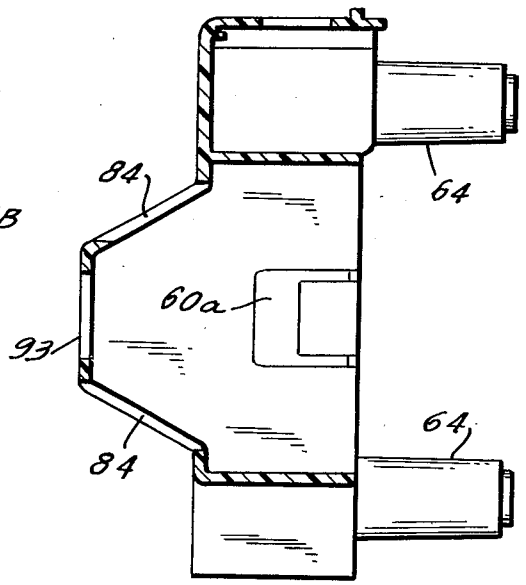
FIGS. 5A and 5B are cross-sections taken through the respective lines 5A—5A and 5B—5B of FIG. 5, looking in the directions of the respective arrows 5A—5A and 5B—5B.
Figure 5:
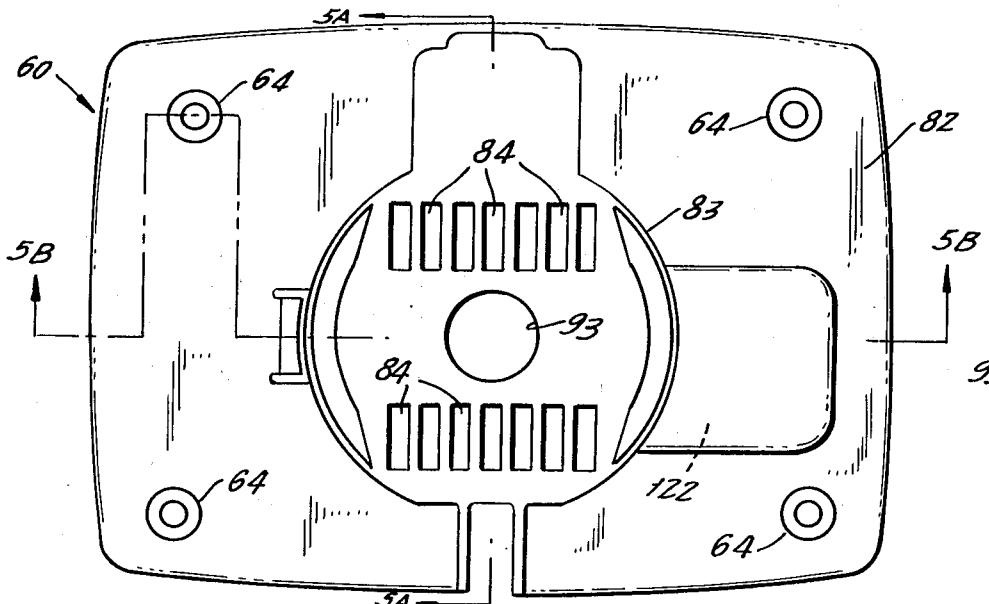
FIG. 5 is an elevation looking at the rear facing surface of the baffle at the rear of the motor.
Figure 5B:
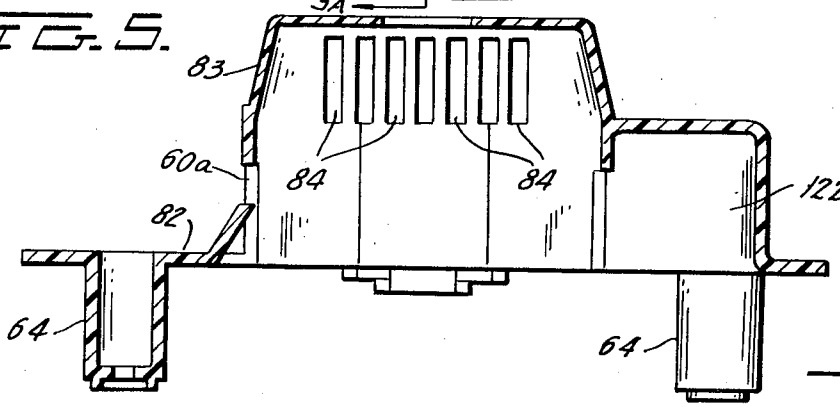

Baffle 60 (FIG. 5) includes main wall 82 that extends across the interior of motor housing 14 and at its central region is provided with cup 83 wherein the rear half of motor 25 is disposed. A plurality of apertures 84 in cup 83 near the rear thereof provide air flow openings. Baffle member 60 also defines chamber 122 wherein switch 44 is disposed with its operating member 86 extending through housing aperture 87 and being engaged by manually operable slide 88 that is accessible outside the motor housing 14 for selectively operating motor 25 on and off.

Baffle 60 is snap fitted on bracket 48 through the cooperation of bracket projections **48*a* (one seen in FIG. 4) and baffle apertures 60*a* (one seen in FIG. 4) to constitute an independent subassembly in which apertured radial projection 50*a* of end bell 50 provides a fingerproof front for chamber 122. End bell 50 and baffle 60 are constructed of flame retardant material so that even if other housing elements are broken or destroyed the uninsulated electrical connections at switch 44** will be surrounded by flame retardant material.

As seen best in FIGS. 3 and 4, rotation of fan impeller 51 by motor 25 moves air through casing 11 along indicated by the broken lines having arrowheads thereon. That is, rotating impeller 51 draws air into tank 12 through inlet 15 and passage 16. This is the main or working air that creates a suction force at a pick-up tool (not shown) disposed at one end of a flexible hose (not shown) whose other end is removably connected to vacuum cleaner 10 at inlet 15, in a manner well known to the art. Air and dirt particles that enter tank 12 enter bag 20 that constitutes a primary filter which traps the dirt. Air flows rearward through bag 20 and then flows through secondary filter 76, typically a flexible sheet of open cell foam material, and slots 120 into impeller chamber 96 through central aperture 72 thereof. Air flow is then radially outward, being deflected rearwardly again by wall 71 and flowing through apertures 95 in motor mounting plate 55. As seen best in FIG. 6, each of the apertures 95 is of relatively small diameter and the plurality of apertures 95 is arranged in a narrow annular array or band consisting of three rows. This arrangement of many small apertures 95, typically 270 in number, suppresses noise without creating excessive back pressure.

Air flow to the rear of motor mounting plate 55 is alongside and through motor 25 to cool the latter. Some of the flow is through apertures 94 in end bell 50. Because of the configuration of baffle 60, air flow is for the most part directed into cup 83 and exists therefrom through slotted apertures 84 and circular aperture 93, and exits motor housing 14 at the rear thereof through slotted apertures 92. Foam noise suppressor 91 is disposed in the air path, being inside of motor housing 19 in front of slots 92. The amount of air forced through motor 25 for cooling thereof may be adjusted by providing apertures (not shown) in transverse wall 82 of baffle 60.

Tank 12 may be released from motor housing 14 by merely disengaging latch 34 from housing 14 and thereafter pivoting tank 12 counterclockwise in an upward direction with respect to FIG. 3 about band 27. Bag 20 is then accessible for removal from tank 12. Bag 20 may be either a reusable or replaceable type.

If it is desired to store vacuum cleaner 10 by hanging it in a vertical position, supported by bracket 110 (FIG. 3) secured to wall 31 by a plurality of fasteners 112, hook 33 is moved above cross piece 111 of bracket 110 and then downward to engage cross-piece 111 so that bracket 110 will secure the support vacuum cleaner 10 in a vertical position with its wheel 36 resting against wall 31.

Although a preferred embodiment of this invention has been described, many variations and modifications will now be apparent to those skilled in the art, and it is therefore preferred that the instant invention be limited not by the specific disclosure herein, but only by the appending claims.

I claim:

1. A vacuum cleaner including a casing comprising a tank section for storing dirt picked up by said vacuum cleaner, and a housing section to the rear of said tank section; a fan means within said casing; a motor disposed within said housing section and having an output shaft drivingly connected to said fan means to create a main air stream that flows through said casing by drawing air into said tank section through an inlet at the front thereof and exhausting air through an outlet at the rear of said housing; said shaft extending in a front to rear direction and said main air stream moving longitudinally of said shaft to cool said motor; first means defining a chamber in front of said motor and within which said fan means is rotatably disposed; said first means including a mounting member to which said motor is secured; said mounting member being disposed to the rear of said fan means and closely spaced therefrom; said airstream flowing through a plurality of apertures in surface portions of said mounting member; said surface portions being transverse to said front to rear direction; said first means also including a fan housing in front of said mounting member; a baffle member having a cup formation into which the rear of said motor extends; a common fastening means mechanically securing said mounting member, said fan housing and said baffle said motor housing, member together as a unitary structure.

2. A vacuum cleaner including a casing comprising a tank section for storing dirt picked up by said vacuum cleaner, and a housing section to the rear of said tank section; a fan means within said casing; a motor disposed within said housing section and having an output shaft drivingly connected to said fan means to create a main air stream flowing through said casing by drawing air into said tank section through an inlet at the front thereof and exhausting air through an outlet at the rear of said housing section; said shaft extending in a front to rear direction and said main air stream moving longitudinally of said shaft to cool said motor; first means defining a chamber in front of said motor and within which said fan means is rotatably disposed; said first means including a narrow band formation having a front edge against which said tank section is pressed and a rear edge against which said housing section is pressed to align said housing section with said tank section and fill a narrow gap therebetween; said first means also including a fan housing formed integrally with said narrow band formation.

3. A vacuum cleaner as set forth in claim 2 in which the first means also includes a mounting member to which said motor is secured; said mounting member being disposed to the rear of said fan means and closely spaced therefrom; said mounting member being at the rear of said fan housing.

4. A vacuum cleaner as set forth in claim 3 also including a baffle member having a cup formation into which the rear of said motor extends.

5. A vacuum cleaner as set forth in claim 4 in which the baffle member includes formations operatively positioned to direct said airstream toward said motor for cooling thereof.

6. A vacuum cleaner as set forth in claim 4 also including a common fastening means mechanically securing said motor housing, said mounting member, said fan housing and said baffle member together as a unitary structure.

7. A vacuum cleaner as set forth in claim 4 in which said baffle member is snap fitted on said motor to form a subassembly; said baffle including a switch chamber wherein electrical connections are disposed; said motor including an end bell at the front thereof; said bell being a molded insulating member having an apertured radial projection constituting a front closure for said chamber.

8. A vacuum cleaner as set forth in claim 3 also including a support member secured to the fan housing at the front thereof, a secondary filter pad mounted to said support member for removal from the front thereof.

9. A vacuum cleaner as set forth in claim 1 in which the baffle member includes formations operatively positioned to direct said airstream toward said motor for cooling thereof.

10. A vacuum cleaner as set forth in claim 9 in which the airstream flows through a plurality of relatively small apertures in said mounting member; said plurality of relatively small apertures being arranged in a relatively narrow band in the vicinity of the outer edge of said fan means.

11. A vacuum cleaner as set forth in claim 10 also including wheel means at one end of said casing; a buckle member mounted on one of said sections and including a latch portion operatively engageable with a cooperating formation in the other of said sections to releaseably secure said sections together; said buckle member also including a skid portion engageable with a surface for supporting said vacuum cleaner in a horizontal position and on which said wheel means rest; said buckle further including a hook portion engageable with a wall bracket for hanging said vacuum cleaner in a vertical position; said skid portion being positioned between the latch portion and the hook portion.

12. A vacuum cleaner as set forth in claim 1 in which the airstream flows through a plurality of relatively small apertures in said mounting member; said plurality of relatively small apertures being arranged in a relatively narrow band in the vicinity of the outer edge of said fan means.

13. A vacuum cleaner as set forth in claim 12 in which said plurality of relatively small apertures number at least two hundred.

14. A vacuum cleaner including a casing comprising a tank section for storing dirt picked up by said vacuum cleaner, and a housing section to the rear of said tank section; a fan means within said casing; a motor disposed within said housing section and having an output shaft drivingly connected to said fan means to create a main air stream that flows through said casing by drawing air into said tank section through an inlet at the front thereof and exhausting air through an outlet at the rear of said housing; said shaft extending in a front to rear direction and said main air stream moving longitudinally of said shaft to cool said motor; first means defining a chamber in front of said motor and within which said fan means is rotatably disposed; said first means including a mounting member to which said motor is secured; said mounting member being disposed to the rear of said fan means and closely spaced therefrom; said airstream flowing through a plurality of apertures in surface portions of said mounting member; said surface portions being transverse to said front to rear direction; said first means also including a fan housing in front of said mounting member; a baffle member having a cup formation into which the rear of said motor extends; said motor including an end bell at the front thereof; said end bell including a plurality of forwardly extending studs; said mounting member having a plurality of mounting apertures into which said studs extend; and a resilient bushing in each of said mounting apertures surrounding the stud that extends into the particular aperture.

* * * * *

UNITED STATES PATENT AND TRADEMARK OFFICE

CERTIFICATE OF CORRECTION

PATENT NO. : 4,547,927

DATED : October 22, 1985

INVENTOR(S) : Robert C. Berfield

It is certified that error appears in the above-identified patent and that said Letters Patent is hereby corrected as shown below:

Claim 1, line 50 - after "said" (first occurrence) insert --housing section, said--

Claim 1, line 51 - delete "said motor housing,"

Signed and Sealed this

*Twenty-sixth* Day of *August 1986*

[SEAL]

*Attest:*

DONALD J. QUIGG

*Attesting Officer*

*Commissioner of Patents and Trademarks*